US008655205B2

(12) United States Patent
Karasawa et al.

(10) Patent No.: US 8,655,205 B2
(45) Date of Patent: Feb. 18, 2014

(54) WASTE TONER CONTAINER AND IMAGE FORMING APPARATUS INCLUDING SAME

(75) Inventors: Shinya Karasawa, Kanagawa (JP); Ken Amemiya, Tokyo (JP); Michiya Okamoto, Kanagawa (JP); Takuma Iwasaki, Kanagawa (JP); Yuta Azeyanagi, Kanagawa (JP); Hiroyuki Uenishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 13/368,424

(22) Filed: Feb. 8, 2012

(65) Prior Publication Data

US 2012/0237230 A1 Sep. 20, 2012

(30) Foreign Application Priority Data

Mar. 17, 2011 (JP) ..... 2011-059427
Sep. 16, 2011 (JP) ..... 2011-202768

(51) Int. Cl.
*G03G 21/12* (2006.01)

(52) U.S. Cl.
USPC ..... 399/35; 399/120; 399/360

(58) Field of Classification Search
USPC ..... 399/35, 120, 360
See application file for complete search history.

(56) References Cited

U.S. PATENT DOCUMENTS

| | | | | |
|---|---|---|---|---|
| 7,373,092 | B2 * | 5/2008 | Tawada | 399/35 |
| 7,991,344 | B2 * | 8/2011 | Naruse | 399/358 |
| 8,190,041 | B2 * | 5/2012 | Kumagai | 399/35 |
| 2004/0258441 | A1 * | 12/2004 | Park et al. | 399/350 |
| 2005/0163545 | A1 | 7/2005 | Cook et al. | |
| 2006/0039710 | A1 * | 2/2006 | Tawada | 399/35 |
| 2007/0110458 | A1 | 5/2007 | Inoue et al. | |
| 2008/0226333 | A1 | 9/2008 | Ono et al. | |
| 2009/0097879 | A1 | 4/2009 | Nagashima et al. | |
| 2009/0196666 | A1 | 8/2009 | Wasai | |
| 2010/0080600 | A1 | 4/2010 | Okamoto et al. | |
| 2010/0303497 | A1 | 12/2010 | Tsusaka et al. | |
| 2011/0097124 | A1 | 4/2011 | Koike et al. | |
| 2012/0014728 | A1 | 1/2012 | Karasawa et al. | |

FOREIGN PATENT DOCUMENTS

| | | | | |
|---|---|---|---|---|
| JP | 10-282776 | | 10/1998 | |
| JP | 11133722 | A * | 5/1999 | G03G 15/08 |
| JP | 11-161124 | A | 6/1999 | |
| JP | 2005-315953 | | 11/2005 | |
| JP | 2006-011360 | A | 1/2006 | |
| JP | 2008224820 | A * | 9/2008 | |
| JP | 2009-063772 | A | 3/2009 | |

OTHER PUBLICATIONS

Japanese Office Action mailed Aug. 2, 2013.

* cited by examiner

*Primary Examiner* — G. M. Hyder
(74) *Attorney, Agent, or Firm* — Harness, Dickey & Pierce, P.L.C.

(57) ABSTRACT

A waste toner container includes a waste toner reservoir extending in a depth direction, an inlet portion provided above the waste toner reservoir, in which at least one waste toner inlet is formed, a first conveyance member provided in the waste toner reservoir to transport the waste toner in the depth direction, the first conveyance member movable upward as the amount of the waste toner in the waste toner reservoir increases, a second conveyance member provided in the inlet portion to transport the waste toner in a width direction and including a drive transmitter to transmit a driving force from the second conveyance member to the first conveyance member, and a waste toner detection unit to detect whether an amount of the waste toner in the waste toner container reaches a predetermined amount by detecting upward movement of the first conveyance member.

11 Claims, 9 Drawing Sheets

WASTE TONER CONTAINER AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2011-059427 filed on Mar. 17, 2011 and 2011-202768 filed on Sep. 16, 2011, in the Japan Patent Office, the entire disclosure of each of which is hereby incorporated by reference herein.

FIELD OF THE INVENTION

The present invention relates to an image forming apparatus such as a photocopier, facsimile machine, printer, or multifunction machine having several of those capabilities, and a waste toner container used therein.

BACKGROUND OF THE INVENTION

Generally, image forming apparatuses such as copiers and printers include an image bearer, such as a drum-shaped or belt-shaped photoreceptor and a drum-shaped or belt-shaped intermediate transfer member, and a cleaning unit to remove any toner remaining on the image bearer after image transfer. The toner removed from the image bearer (i.e., waste toner) is collected in a waste toner container.

Being filled to capacity (or close to the capacity) with the waste toner, the waste toner container is removed from the apparatus body of the image forming apparatus, and then an empty waste toner container is set in the apparatus instead.

For example, US-2007110458-A1, US-2004258441-A1, and JP-2009-63772-A propose waste toner containers shaped like substantially rectangular parallelepipeds and containing a waste toner conveyance member, such as a paddle. The waste toner conveyance member distributes waste toner uniformly and entirely in the waste toner container.

JP-2009-63772-A further proposes a waste toner detector to detect whether the waste toner container is filled to capacity with waste toner. Specifically, an opening formed on the side of the waste toner container is covered with a rubber seal, and a filler is provided outside the waste toner container to contact the rubber seal externally. When the amount of the waste toner collected in the waste toner container reaches a predetermined amount, the rubber sealed is pushed by the waste toner and pushes the filler. The movement of the filler is optically detected by a sensor.

However, if the waste toner container is a substantially rectangular parallelepiped, it is difficult to make full use of the space inside the image forming apparatus and to secure a sufficient capacity of the waste toner container. Accordingly, replacement cycle of the waste toner container is relatively short.

In view of the foregoing, a part of the waste toner container, which typically extends in a depth direction of the apparatus, may be projected upward to effectively use the space inside the apparatus except functional areas, thereby increasing the capacity of the waste toner container. In such a configuration, it is necessary to detect whether the waste toner container including the projecting portion is filled to capacity with toner entirely and detect timely and reliably it when the waste toner container is full.

BRIEF SUMMARY OF THE INVENTION

In view of the foregoing, one embodiment of the present invention provide a waste toner container used in an image forming apparatus. The waste toner container includes a waste toner reservoir extending in a depth direction of the image forming apparatus for containing waste toner removed from an image bearer, an inlet portion provided above the waste toner reservoir, in which at least one waste toner inlet is formed to receive the waste toner flowing to the waste toner reservoir, a first conveyance member provided in the waste toner reservoir, a second conveyance member provided in the inlet portion, and a waste toner detection unit. The first conveyance member transports the waste toner accumulating in the waste toner reservoir in the depth direction and movable upward as the amount of the waste toner in the waste toner reservoir increases. The second conveyance member transports the waste toner in the inlet portion in a width direction perpendicular to the depth direction. The second conveyance member includes a drive transmitter to transmit a driving force from the second conveyance member to the first conveyance member. The waste toner detection unit detects whether an amount of the waste toner in the waste toner container reaches a predetermined amount by detecting upward movement of the first conveyance member.

In another embodiment, an image forming apparatus includes an image forming unit to form a toner image on an image bearer, a cleaning unit to remove untransferred toner as waste toner form the image bearer after the toner image is transferred therefrom, and the waste toner container described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
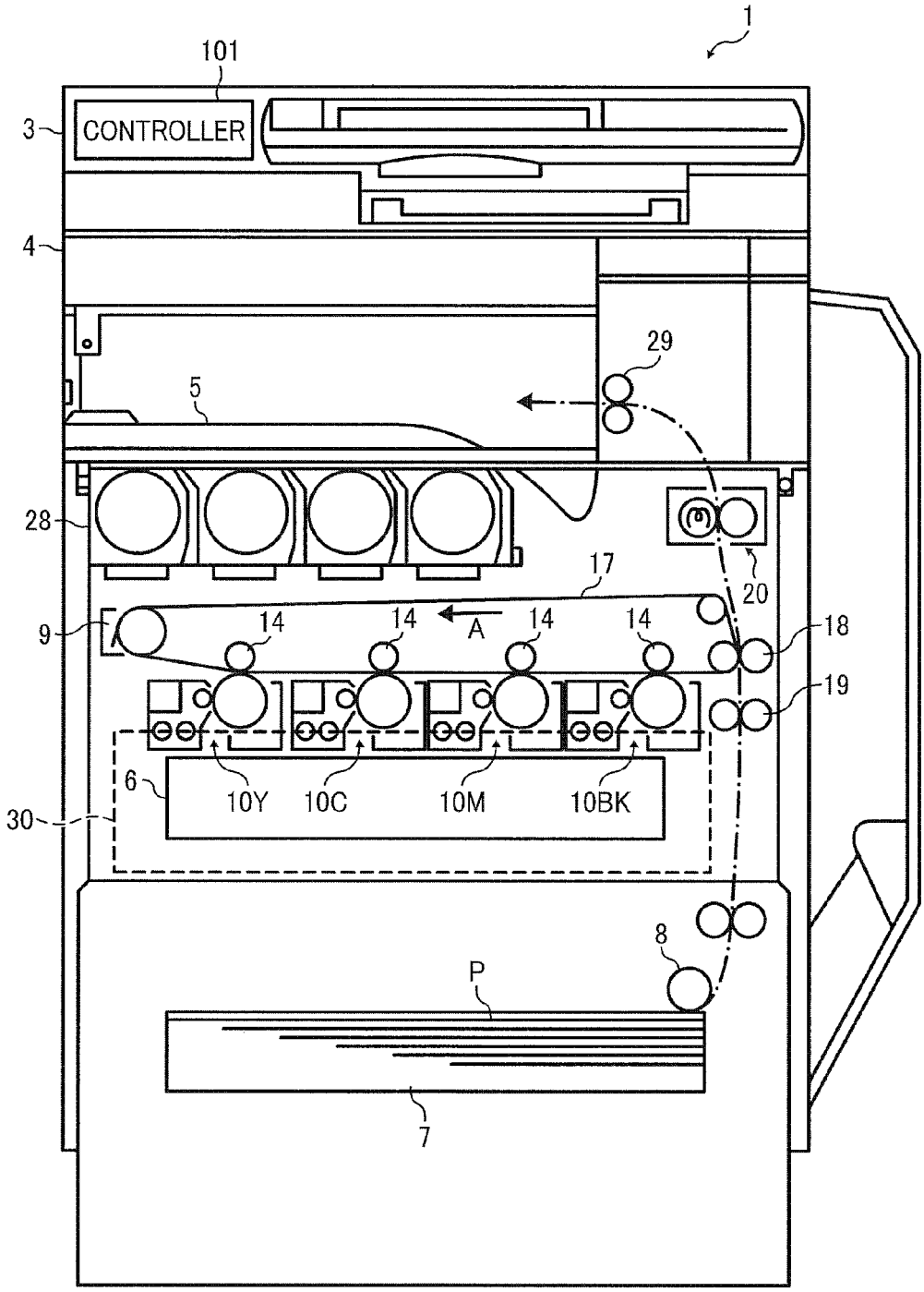
FIG. 1 is a schematic diagram illustrating a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

First Embodiment

A first embodiment is described with reference to FIGS. 1 to 16.

Referring to FIG. 1, a configuration and operation of an image forming apparatus 1 according to the first embodiment is described below.

The image forming apparatus 1 according to the present embodiment is a tandem multicolor image forming apparatus and includes multiple process cartridges 10Y, 10M, 10C, and 10BK, serving as image forming units, that are arranged in parallel to each other, facing an intermediate transfer belt 17 serving as an intermediate transfer member.

In FIG. 1, reference characters 3 represents a document feeder to send an original document to a document reading unit 4 that reads image data of the original document, 6 represents a writing unit (exposure unit) to emit laser beams L (shown in FIG. 2) according to the image data, 7 represents a sheet feeder for containing sheets P of recording media, 10Y, 10M, 10C, and 10BK represent the process cartridges for respective colors (yellow, magenta, cyan, and black), 17 represents the intermediate transfer belt, serving as an image bearer on which multiple single-color toner images are superimposed one on another, 18 represents a secondary-transfer roller to transfer the superimposed toner image from the intermediate transfer belt 17 onto the sheet P, 20 represents a fixing device to fix the toner image on the sheet P, 28 represents toner containers from which respective color toners are supplied to development devices 13 (shown in FIG. 2) in the respective process cartridges 10Y, 10M, 10C, and 10BK, and 30 represents a waste toner container for containing waste toner.

The image forming apparatus 1 further includes a controller 101 that can be a computer including a central processing unit (CPU) and associated memory units (e.g., ROM, RAM, etc). The computer performs various types of control processing by executing programs stored in the memory.

Figure 2:
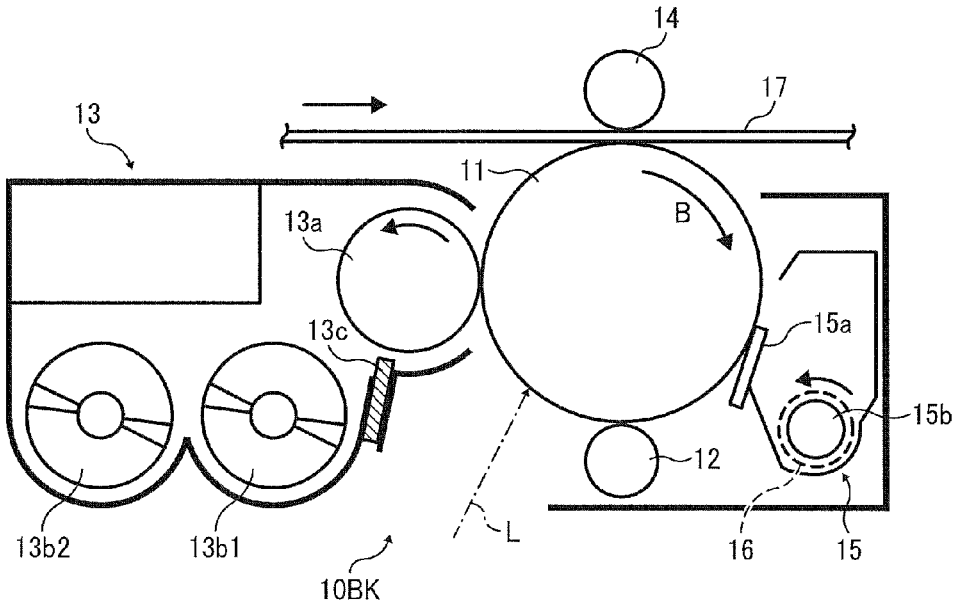
FIG. 2 is a schematic diagram illustrating a configuration of an image forming unit included in the image Ruining apparatus shown in FIG. 1.

Referring to FIG. 2, each of the process cartridges 10Y, 10M, 10C, and 10BK includes a photoreceptor drum 11 serving as an image bearer, a charging unit 12, the development device 13, and a cleaning unit 15, which are housed in a common unit casing. Each process cartridge 10 is replaced with a new one when its operational life expires.

In the process cartridges 10Y, 10M, 10C, and 10BK, yellow, magenta, cyan, and black toner images are formed on the respective photoreceptor drums 11.

Operations of the image forming apparatus 1 shown in FIG. 1 to form multicolor images are described below.

Conveyance rollers provided in the document feeder 3 transport original documents set on a document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The color sensor reads the multicolor image data of the original for each decomposed colors of red, green, and blue (RGB), and converts the image data into electrical image signals. Further, the image signals are transmitted to an image processor (not shown) that performs image processing (e.g., color conversion, color calibration, and spatial frequency adjustment) on the image signals, and thus image data of yellow, magenta, cyan, and black is obtained.

The yellow, magenta, cyan, and black single-color image data is then transmitted to the writing unit 6, and the writing unit 6 directs the laser beams L (exposure light) corresponding to the single-color image data to the respective photoreceptor drums 11 of the process cartridges 10Y, 10M, 10C, and 10BK.

Meanwhile, the four photoreceptor drums 11 rotate clockwise in FIG. 2 as indicated by arrow B. As shown in FIG. 2, a surface of the photoreceptor drum 11 is charged uniformly at a position facing the charging unit 12 (e.g., a charging roller) by it (charging process). Thus, the surface of the photoreceptor drum 11 is charged to a predetermined electrical potential.

When the surfaces of the photoreceptor drums 11 reach positions to receive the respective laser beams L, the writing unit 6 directs the laser beams 1 according to the respective color image date, emitted from the light sources, to the respective photoreceptor drums 11. Although not shown in the drawings, the laser beams L are deflected by a polygonal mirror and pass through multiple lenses. Then, the laser beams L pass through different optical paths for yellow, magenta, cyan, and black (exposure process).

The laser beam L corresponding to the yellow component is directed to the photoreceptor drum 11 in the process cartridge 10Y that is the first from the left in FIG. 1 among the four process cartridges 10. The polygon mirror, not shown, that rotates at high velocity deflects the laser beam L for yellow in a direction of a rotary axis of the photoreceptor drum 11 (main scanning direction) so that the leaser beam L scans the surface of the photoreceptor drum 11. Thus, an electrostatic latent image for yellow is formed on the photoreceptor drum 11 charged by the charging unit 12.

The laser beam L corresponding to the cyan component is directed to the surface of the photoreceptor drum 11 in the process cartridge 10C that is the second from the left in FIG. 1, thus forming an electrostatic latent image for cyan thereon. Similarly, the laser beam L corresponding to the magenta component is directed to the surface of the photoreceptor drum 11 in the process cartridge 10M that is the third from the left in FIG. 1, thus forming an electrostatic latent image for magenta thereon. The laser beam L corresponding to the black component is directed to the surface of the photoreceptor drum 11 in the process cartridge 10BK that is the fourth from the left in FIG. 1 (extreme upstream in the direction indicated by arrow A shown in FIG. 1, in which the intermediate transfer belt 17 rotates), thus forming an electrostatic latent image for black thereon.

Then, each photoreceptor drum 11 reaches a position facing the development device 13 shown in FIG. 2, and the development device 13 supplies toner of the corresponding color to the photoreceptor drum 11. Thus, the latent images on the respective photoreceptor drums 11 are developed into different single-color toner images (development process).

Subsequently, the surface of the photoreceptor drum 11 reaches a position facing the intermediate transfer belt 17, serving as the image bearer as well as an intermediate transfer member. Primary-transfer rollers 14 are provided in contact with an inner circumferential surface of the intermediate transfer belt 17 at the positions where the respective photoreceptor drums 11 face the intermediate transfer belt 17. The toner images formed on the respective photoreceptor drums 11 are sequentially transferred and superimposed one on another on the intermediate transfer belt 17 by the primary transfer rollers 14, forming a multicolor toner image thereon (primary transfer process).

After the primary transfer process, the surface of each photoreceptor drum 11 reaches a position facing the cleaning unit 15, which collects any toner remaining on the photoreceptor drum 11, which is hereinafter referred to as "untransferred toner" (cleaning process).

Additionally, the surface of each photoreceptor drum 11 passes through a discharge device, not shown, and thus a sequence of image forming processes performed on each photoreceptor drum 11 is completed.

Meanwhile, the surface of the intermediate transfer belt 17 carrying the superimposed toner image moves in the direction indicated by arrow A and reaches the position facing the secondary-transfer roller 18. The secondary-transfer roller 18 transfers the multicolor toner image from the intermediate transfer belt 17 to the sheet P (secondary-transfer process).

Further, the surface of the intermediate transfer belt 17 reaches a position facing a belt cleaning unit 9. The belt cleaning unit 9 collects any untransferred toner remaining on the intermediate transfer belt 17, and thus a sequence of transfer processes performed on the intermediate transfer belt 17 is completed.

The sheet P is transported from the sheet feeder 7 to the secondary-transfer roller 18 via a sheet guide, a pair of registration rollers 19, and the like.

More specifically, a feed roller 8 sends out the sheet P from a sheet cassette of the sheet feeder 7, and the sheet P is then guided by the sheet guide, not shown, to the registration rollers 19. The registration rollers 19 forward the sheet P to the secondary-transfer nip, timed to coincide with arrival of the multicolor toner image formed on the intermediate transfer belt 17.

Then, the sheet P carrying the multicolor image is transported to a fixing device 20. The fixing device 20 includes a fixing roller and a pressure roller pressing against each other, forming a nip therebetween, in which the multicolor image is fixed on the sheet P.

After the fixing process, a pair of discharge rollers 29 discharges the sheet P as an output image to a stack portion 5, provided outside the image forming apparatus 1. Thus, a sequence of image forming processes is completed.

Next, image forming units are described in further detail below with reference to FIG. 2.

FIG. 2 is an end-on axial view of the process cartridge 10BK for black. Other three process cartridges 10Y, 10M, and 10C have similar configuration to that of the process cartridge 10BK except the color of the toner used therein, and thus drawings and descriptions thereof are omitted.

As shown in FIG. 2, the process cartridge 10BK includes the photoreceptor drum 11 serving as the image bearer, the charging unit 12 to charge the surface of the photoreceptor drum 11, the development device 13 to develop the latent image formed on the photoreceptor drum 11, and the cleaning unit 15 to clean the photoreceptor drum 11, housed in the common unit casing.

The photoreceptor drum 11 used in the present embodiment is an organic photoreceptor charged to a negative polarity and includes a photosensitive layer formed on a drum-shaped electroconductive support member. For example, the photoreceptor drum 11 is multilayered, and a base coat serving as an insulation layer, the photosensitive layer, and a protection layer (surface layer) are formed sequentially on the support member. The photosensitive layer includes a charge generation layer and a charge transport layer.

The charging unit 12 may be a charging roller that includes an electroconductive metal core and an elastic layer of moderate resistivity overlying an outer circumference of the metal core. Receiving a predetermined voltage from a power source, the charging unit 12 uniformly charges the surface of the photoreceptor drum 11 facing the charging unit 12.

The development device 13 includes a development roller 13*a* disposed facing the photoreceptor drum 11, a first conveyance screw 13*b*1 disposed facing the development roller 13*a*, a second conveyance screw 13*b*2 disposed facing the first conveyance screw 13*b*1 via a partition, and a doctor blade 13*c* disposed facing the development roller 13*a*. The development roller 13*a* includes a magnet roller or multiple magnets fixed in position relative to the casing of the development device 13 and a sleeve that rotates around the magnets. The magnets generate magnetic poles around the circumferential surface of the development roller 13*a*, and thus developer (i.e., toner) is carried on the circumferential surface of the development roller 13*a*.

The development device 13 contains two-component developer consisting essentially of carrier (carrier particles) and toner (toner particles). The toner used in the present embodiment has a smaller particle diameter and is substantially spherical in shape.

More specifically, the toner has a circularity not smaller than 0.92. The circularity herein is a mean circularity measured by a flow-type particle image analyzer FPIA-2000 from SYSMEX CORPORATION. More specifically, as a dispersant, 0.1 ml to 0.5 ml of surfactant (preferably, alkylbenzene sulfonate) is put in 100 ml to 150 ml of water from which impure solid materials are previously removed, and 0.1 g to 0.5 g of the sample (toner) is added to the mixture. Then, the mixture including the toner is dispersed with an ultrasonic disperser for 1 to 3 minutes to prepare a dispersion liquid having a concentration of from 3,000 to 10,000 pieces/μl, and the toner shape and distribution are measured with the above-mentioned measurer.

The toner in the present embodiment has a first shape factor SF-1 and a second shape factor SF-2 both within a range of 100 to 180, for example.

Additionally, the toner in the present embodiment has a volume-average particle diameter (Dv) of from 3 μm to 8 μm, and the ratio of the volume average particle diameter (Dv) to the number average particle diameter (Dn) is within a range of from 1.05 to 1.40 (Dv/Dn), for example.

Further, the ratio of the long axis (r1) to the short axis (r2) of the toner (r1/r2) is within a range from 0.5 to 1.0, the ratio of thickness (r3) to the short axis (r2) of the toner (r3/r2) is within a range from 0.7 to 1.0, wherein $r1 \geq r2 \geq r3$.

Such substantially spherical toner having a smaller particle diameter can be produced as follows: Polyester prepolymer having a functional group including a nitrogen atom; polyester; a colorant; and a release agent are dispersed in an organic solvent, thus producing a toner material solution. Then, the toner is produced through at least one of cross-linking and elongation reaction of the toner material solution in an aqueous medium that includes fine resin particles.

Referring to FIG. 2, the cleaning unit 15 includes a cleaning blade 15*a* disposed in contact with the photoreceptor drum 11, a conveyance tube 16 in which a conveyance coil 15*b* is provided, and the like. The untransferred toner removed from the photoreceptor drum 11 and collected in the cleaning unit 15 is transported as waste toner to the waste toner container 30 (shown in FIG. 3) through the conveyance tube 16. The cleaning blade 15*a* is formed of rubber such as urethane rubber, disposed at a predetermined angle to the surface of the photoreceptor drum 11 and pressed against the surface of the photoreceptor drum 11 with a predetermined pressure. With this arrangement, any substance such as toner and dust adhering to the surface of the photoreceptor drum 11 can be removed mechanically and is collected in the cleaning unit 15. Then, the untransferred toner collected in the cleaning unit 15 is transported through the conveyance tube 16 in which the conveyance coil 15*b* is provided and collected in the waste toner container 30 as waste toner.

Similarly, the belt cleaning unit 9 shown in FIG. 1 includes a cleaning blade disposed in contact with the intermediate transfer belt 17, and a conveyance tube 16 in which a conveyance coil is provided, and the like. The untransferred toner removed from the intermediate transfer belt 17 and collected in the belt cleaning unit 9 is transported as waste toner to the waste toner container 30 (shown in FIG. 3) through the conveyance tube 16. Then, the untransferred toner collected in the belt cleaning unit 9 is transported through the conveyance tube 16 in which a conveyance coil is provided and collected as waste toner in the waste toner container 30, which is described in further detail later.

It is to be noted that, although the substances adhering to the photoreceptor drum 11 or the intermediate transfer belt 17 include paper dust resulting from the sheet P, additives to the toner, substances generated on the photoreceptor drum 11 while the charging roller 12 discharges the photoreceptor drum 11 (hereinafter "discharge product"), and the like in addition to the untransferred toner, these substances are collectively referred to as "untransferred toner" in this specification.

The image forming processes are described in further detail below with reference to FIG. 2.

The development roller 13*a* rotates counterclockwise in FIG. 2 as indicated by an arrow shown in FIG. 2. In the development device 13, as the first and second conveyance screws 13*b*1 and 13*b*2, arranged via the partition, rotate, the developer is circulated in the longitudinal direction of the development device 13, which is perpendicular to the surface of the paper on which FIG. 2 is drawn, being mixed with fresh toner supplied from the toner container 28 by a toner supply unit.

Thus, the toner is electrically charged through friction with the carrier and adsorbed to the carrier. Then, the toner is carried on the development roller 13*a* together with the carrier. When the developer reaches a position facing the doctor blade 13*c* as the development roller 13*a* rotates, the amount of the developer on the development roller 13*a* is adjusted to a suitable amount by the doctor blade 13*c*, after which the developer is transported to a development area facing the photoreceptor drum 11.

In the development area, the toner in the developer adheres to the electrostatic latent image formed on the photoreceptor drum 11. More specifically, the electrical potential in an image area to which the laser beam L is directed to form the latent image (exposure potential) is different from that of a development bias applied to the development roller 13*a* (development potential), and the difference in electrical potential generates an electrical field. The toner is attracted to the latent image by the electrical field, thus forming a toner image.

Subsequently, most of the toner caused to adhere to the photoreceptor drum 11 in the development process is transferred to the intermediate transfer belt 17, and the untransferred toner remaining on the surface of the photoreceptor drum 11 is collected by the cleaning blade 15*a* in the cleaning unit 15.

The toner supply unit (not shown) provided in the apparatus body of the image forming apparatus 1 includes the replaceable bottle-shaped toner containers 28 (shown in FIG. 1) and a toner hopper. The toner hopper holds and drives the toner containers 28, and supplies fresh toner to the development devices 13. In the present embodiment, each toner container 28 contains yellow, magenta, cyan, or black toner. Additionally, a spiral-shaped protrusion is formed on an inner circumferential surface of the toner container (toner bottle) 28.

The fresh toner contained in the toner container 28 is supplied through a toner supply inlet to the development device 13 as the toner therein is consumed. The consumption of the toner in the development device 13 is detected either directly or indirectly using a reflective photosensor positioned facing the photoreceptor drum 11 and a magnetic sensor provided beneath the second conveyance screw 13*b*2.

Next, the configuration and operation of the waste toner container 30 according to the first embodiment are described in further detail below with reference to FIGS. 3 through 15.

It is to be note that arrows D1 and W shown in FIGS. 3, 4, 5, and 7 respectively indicates a depth direction and a width direction (hereinafter also "depth direction D1" and "width direction W") of the waste tone container 30 or the image forming apparatus 1.

Figure 3:
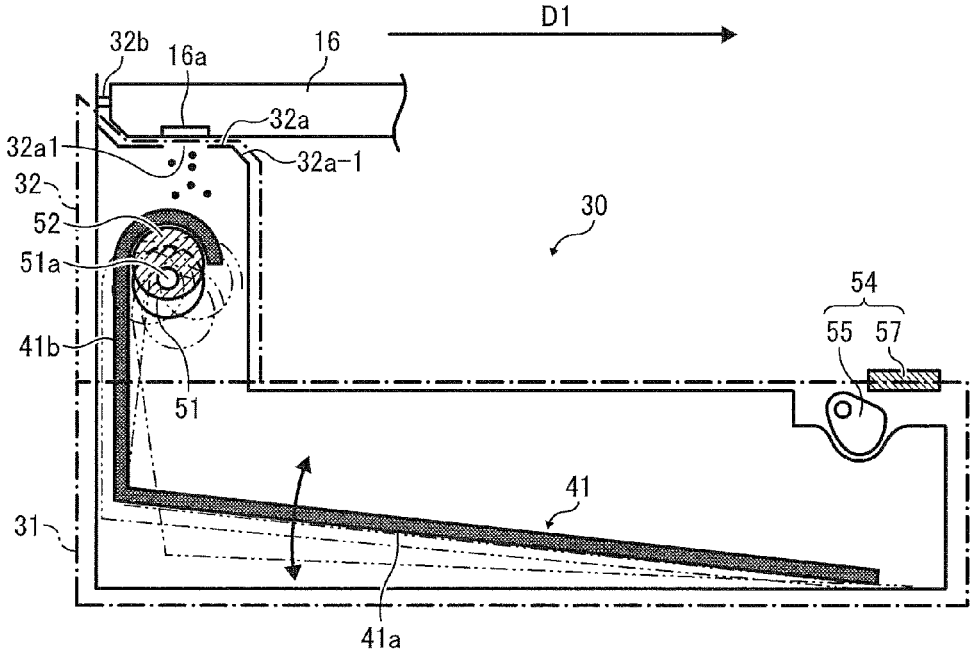
FIG. 3 is a cross-sectional view of a waste toner container along a depth direction.
Figure 4:
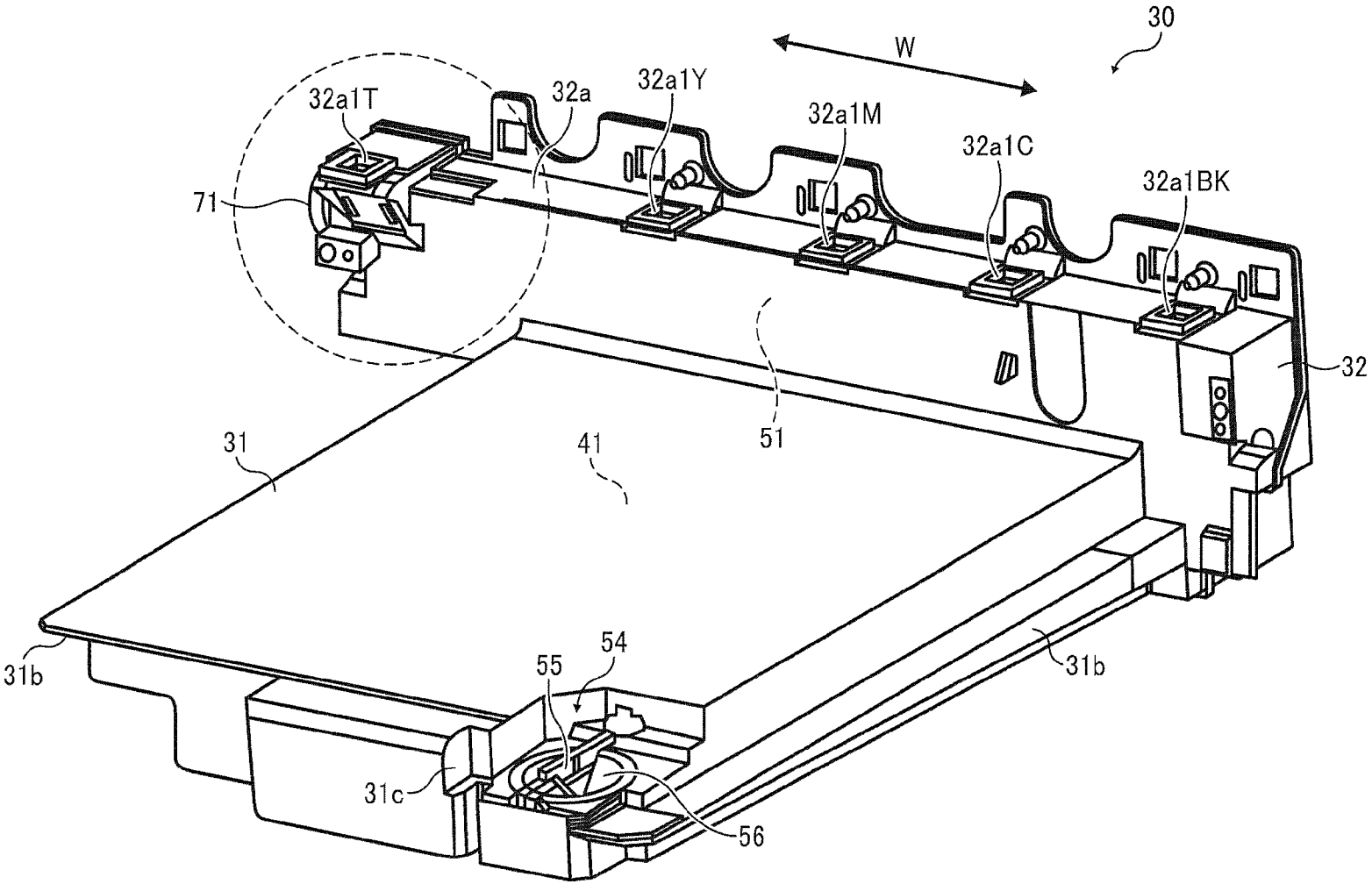
FIG. 4 is a perspective view of the waste toner container.
Figure 6:
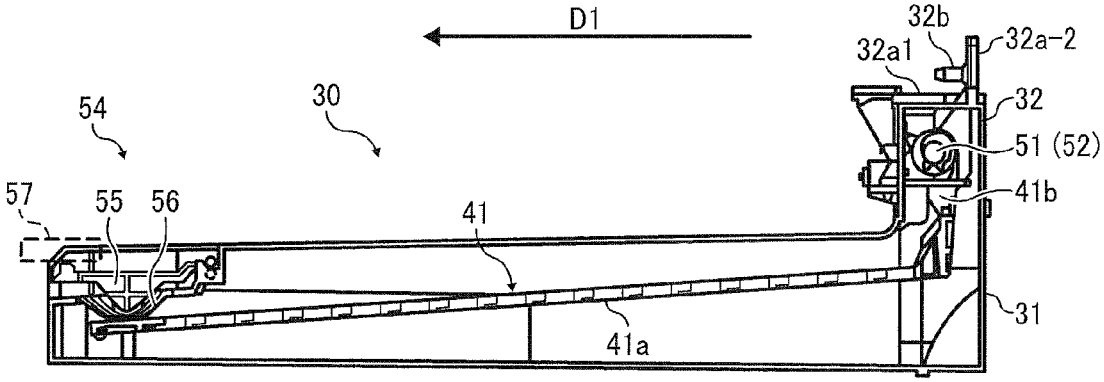
FIG. 6 is a side view of the waste toner container.
Figure 13:
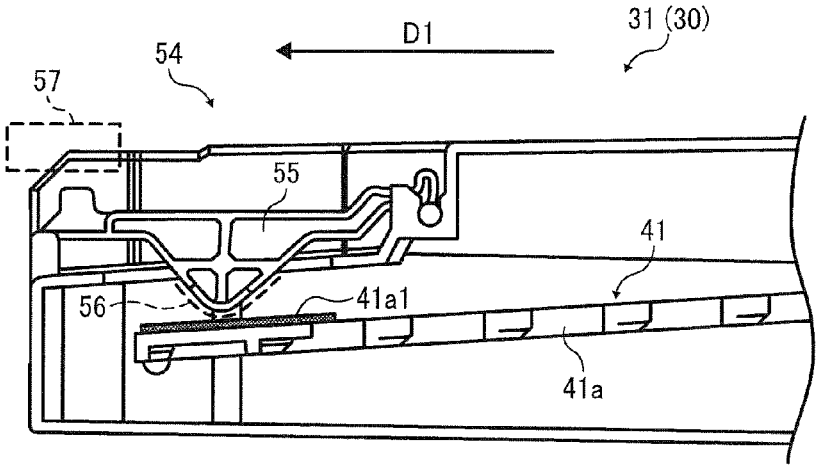
FIG. 13 is an enlarged cross-sectional view illustrating a distal side of the waste toner reservoir in the depth direction.
Figure 14:
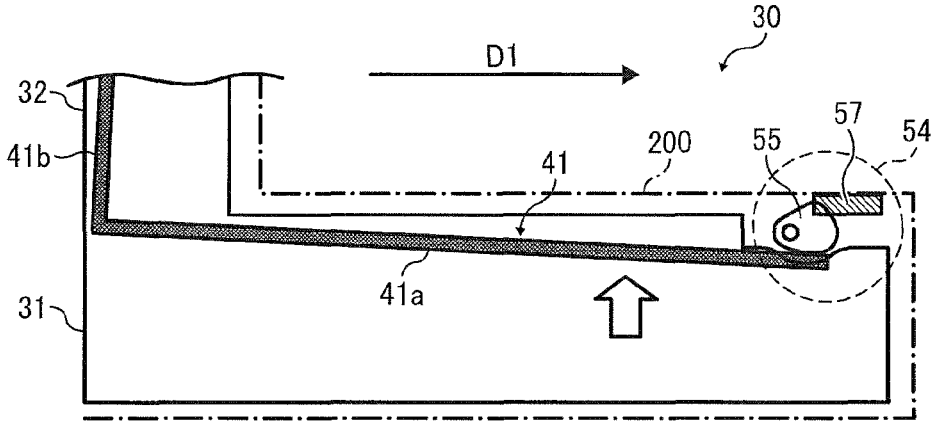
FIG. 14 a partial view of the waste toner container filled with waste toner.

Referring to FIGS. 3, 4, and 6, the waste toner container 30 according to the first embodiment is substantially L-shaped when viewed from a side. It is to be noted that FIGS. 3 and 14 are schematic cross-sectional views of the waste toner container 30 as viewed from the right in FIG. 1, and FIGS. 6 and 13 are cross-sectional views of the waste toner container 30 as viewed from the left in FIG. 1.

Referring to FIGS. 3 through 7, the waste toner container 30 includes a waste toner inlet portion 32 and a waste toner reservoir 31. No partition is provided on the boundary between the waste toner inlet portion 32 and the waste toner reservoir 31. The waste toner flowing from the belt cleaning unit 9 and the cleaning unit 15 is received by the waste toner inlet portion 32 and is stored in the waste toner reservoir 31.

The waste toner reservoir 31 is shaped like a substantially rectangular box extending in the depth direction D1 of the waste toner container 30 or the apparatus body, which is the lateral direction in FIGS. 3 and 6, and perpendicular to the surface of the paper on which FIG. 1 is drawn. Inside the waste toner reservoir 31, a pushing member 41 serving as a first conveyance member is provided. In FIG. 3, reference character 41*a* represents a planar portion, serving as a planar grid portion, of the pushing member 41, and 41*b* represents arms of the pushing member 41.

Additionally, the waste toner reservoir 31 includes a waste toner detection unit 54 (also shown in FIG. 15) to detect whether the waste toner container 30 is full (filled to capacity)

with waste toner. The waste toner detection unit 54 includes a flexible sheet 56 as a flexible member, a filler 55 as a movable member, and a photosensor (optical director) 57 as a detector. For example, the waste toner detection unit 54 detects whether the waste toner accumulating in the waste toner container 30 has reached to a predetermined height.

The waste toner inlet portion 32, serving as a second waste toner reservoir, is substantially shaped like a rectangular box projecting above from the waste toner reservoir 31. A rotary conveyance screw 51 serving as a second conveyance member is provided inside the waste toner inlet portion 32. In FIG. 3, 51*a* represents a rotary shaft of the conveyance screw 51, and reference character 52 represents cams.

Figure 5:
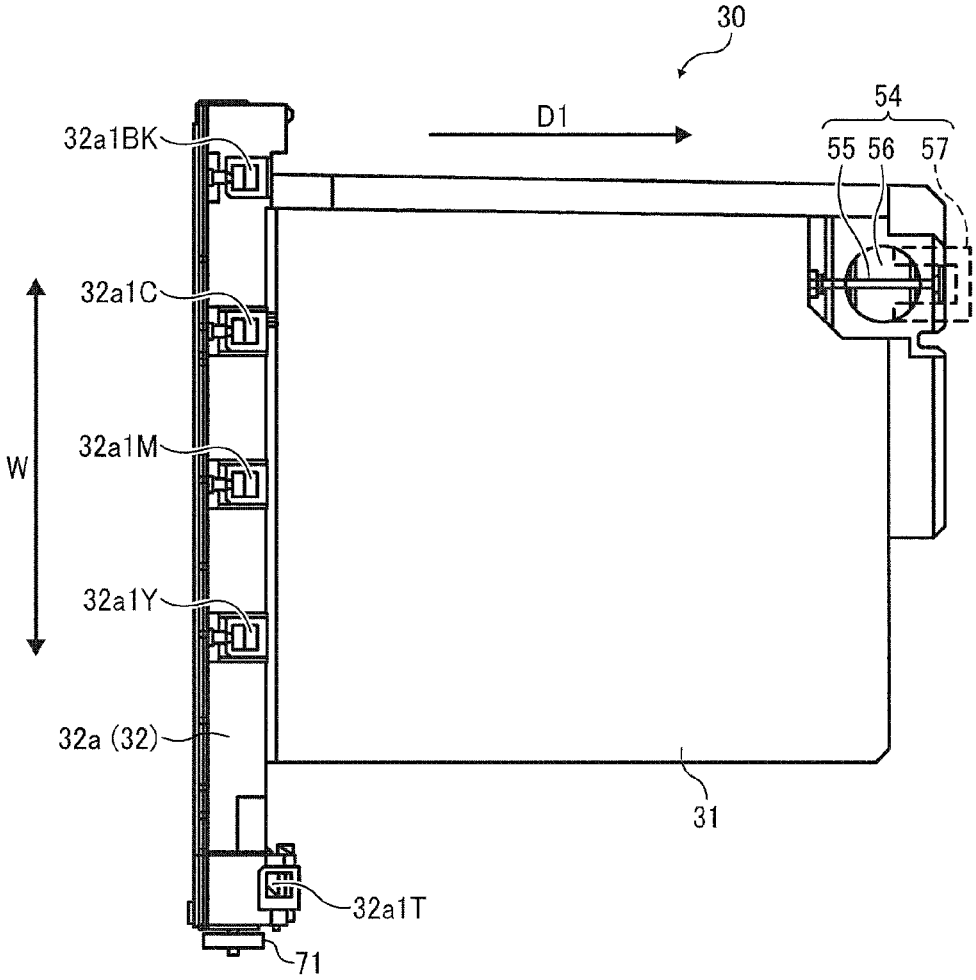
FIG. 5 is a top view of the waste toner container.
Figure 7:
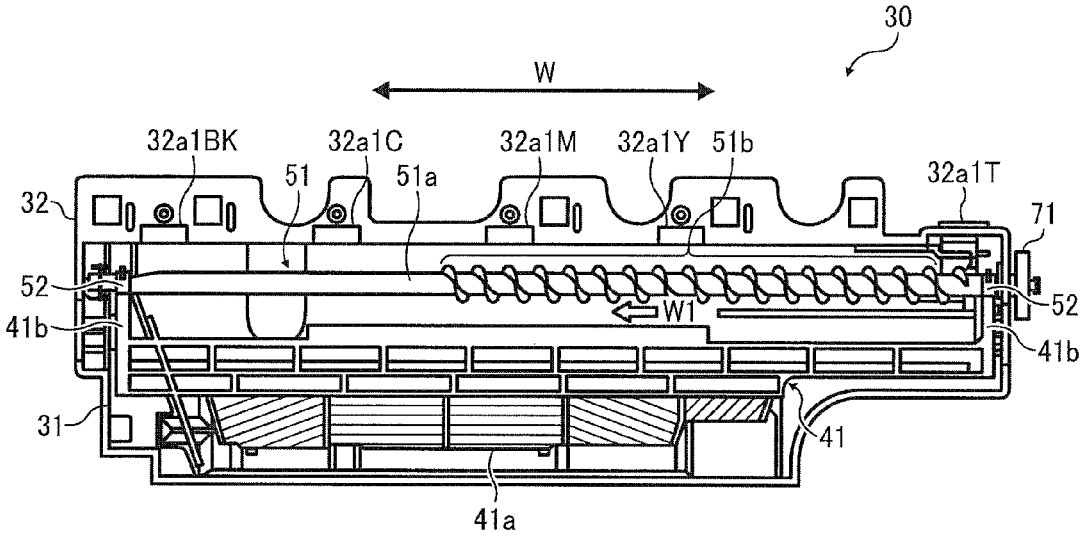
FIG. 7 is a front view of the waste toner container.

Additionally, referring to FIGS. 4, 5, and 7, five inlets 32*a*1Y, 32*a*1M, 32*a*1C, 32*a*1BK, and 32*a*1T are formed in a ceiling portion 32*a* of the waste toner inlet portion 32 through which the waste toner from the cleaning units 15 and belt cleaning unit 9 flows into the waste toner inlet portion 32. It is to be noted that, in FIGS. 3 and 6, for simplicity, the subscripts Y, M, C, BK, and T to "32*a*1" are omitted. Additionally, referring to FIG. 4, a lateral end portion (in the width direction), indicated by a broken circle, of the waste toner inlet portion 32 projects from the waste toner reservoir 31. The waste toner inlet portion 32 is thus projected to make full use of the space inside the apparatus body.

The untransferred toner discharged from the cleaning units 15 of the four process cartridges 10 and that discharged from the belt cleaning unit 9 are collected in the waste toner container 30 configured as described above. The waste toner reservoir 31 can contain a large amount of waste toner, and additional amount of waste toner can be contained in the waste toner inlet portion 32.

Referring to FIG. 7, the untransferred black toner collected by the cleaning unit 15 of the process cartridge 10BK flows into the waste toner inlet portion 32 from the inlet 32*a*1BK, which is the first from the left in FIG. 7 among the five inlets 32*a*1 arranged in the ceiling portion 32*a* of the waste toner inlet portion 32 in the width direction W, perpendicular to the depth direction D1. An outlet 16*a* (shown in FIG. 3) formed in an end portion of the conveyance tube 16 connected to the cleaning unit 15 for black communicates with the inlet 32*a*1BK for black. In this state, the black waste toner is discharged from the outlet 16*a* of the conveyance tube 16 to the waste toner inlet portion 32.

Similarly, the untransferred cyan toner collected by the cleaning unit 15 of the process cartridge 10C flows through a conveyance tube 16 connected to the cleaning unit 15 for cyan. Then, the cyan waste toner is discharged to the waste toner inlet portion 32 from an outlet 16*a* (shown in FIG. 3) formed in an end portion of the conveyance tube 16 communicating with the inlet 32*a*1C for cyan, which is the second from the left in FIG. 7 in the width direction W.

Similarly, the untransferred magenta toner collected by the cleaning unit 15 of the process cartridge 10M flows through a conveyance tube 16 connected to the cleaning unit 15 for magenta. Then, the magenta waste toner is discharged to the waste toner inlet portion 32 from an outlet 16*a* (shown in FIG. 3) formed in an end portion of the conveyance tube 16 communicating with the inlet 32*a*1M for magenta, which is the third from the left in FIG. 7 in the width direction W.

Similarly, the untransferred yellow toner collected by the cleaning unit 15 of the process cartridge 10Y flows through a conveyance tube 16 connected to the cleaning unit 15 for yellow. Then, the yellow waste toner is discharged to the waste toner inlet portion 32 from an outlet 16*a* formed in an end portion of the conveyance tube 16 communicating with the inlet 32*a*1Y for yellow, which is the fourth from the left in FIG. 7 in the width direction W.

Similarly, the untransferred toner collected by the belt cleaning unit 9 flows through a conveyance tube 16 connected to the belt cleaning unit 9. Then, the waste toner is discharged to the waste toner inlet portion 32 from an outlet 16*a* formed in an end portion of the conveyance tube 16 communicating with the inlet 32*a*1T, which is the first from the right in FIG. 7.

It is to be noted that, in FIGS. 4 through 7, the conveyance tubes 16 respectively connected to the inlets 32*a*1Y, 32*a*1M, 32*a*1C, 32*a*1BK, and 32*a*1T are omitted for simplicity.

The waste toner (untransferred toner) flowing from the inlets 32*a*1Y, 32*a*1M, 32*a*1C, 32*a*1BK, and 32*a*1T falls, mainly under its own weight, from the waste toner inlet portion 32 and accumulates in the waste toner reservoir 31 beneath the waste toner inlet portion 32. The pushing member 41, serving as the first conveyance member, includes the planar portion 41*a* that is swingable laterally and vertically as indicated by broken lines in FIG. 3. The pushing member 41 pushes the accumulating waste toner to a distal side in the depth direction D1 of the waste toner container 30, that is, to the right in FIG. 3. When the entire waste toner reservoir 31 is filled to capacity or close to capacity with the waste toner, then the waste toner flowing from the inlets 32*a*1Y, 32*a*1M, 32*a*1C, 32*a*1BK, and 32*a*1T accumulates in the waste toner inlet portion 32.

When the waste toner reaches close to the height of the conveyance screw 51 (second conveyance member), the conveyance screw 51 transports the waste toner in the width direction (indicated by arrow W1 shown in FIG. 7), which is perpendicular to the surface of the paper on which FIG. 3 is drawn, leveling the waste toner. When the waste toner detection unit 54 detects that the waste toner accumulating in the waste toner reservoir 31 as well as the waste toner inlet portion 32 reaches the predetermined amount or height, the controller 101 (shown in FIG. 1) stops conveyance of the waste toner to the waste toner container 30 and causes a display provided to the apparatus body of the image forming apparatus 1 to report that state. Then, recognizing that the waste toner container 30 is filled to capacity with the waste toner, users or service persons can replace the waste toner container 30.

It is to be noted that, to remove the waste toner container 30 from the apparatus body, the user or service person opens a cover of the apparatus body and moves the waste toner container 30 to the left in FIG. 3 (to the front side of the paper on which FIG. 1 is drawn). Then, the user or service person installs a new (empty) waste toner container 30 in the apparatus body to the right in FIG. 3 (to the back side of the paper on which FIG. 1 is drawn) with the cover of the apparatus body opened.

In the first embodiment, to expand the replacement cycle of the waste toner container 30, the waste toner inlet portion 32 is provided above the waste toner reservoir 31 to increase the size (capacity) of the waste toner container 30, making full use of the space inside the image forming apparatus 1 except functional areas such as the image forming units 10, the writing unit 6, and intermediate transfer belt 17 (intermediate transfer belt unit).

As shown in FIG. 7, the conveyance screw 51 serving as the second conveyance member includes the rotary shaft 51*a* extending in the width direction W of the waste toner container 30 and the screw portion 51*b* shaped like a bladed spiral winding around the rotary shaft 51*a*. Both ends of the conveyance screw 51 are supported rotationally by a casing of the waste toner inlet portion 32 via bearings.

More specifically, as shown in FIGS. 3, 7, 11, and 12, the cams 52 are provided on either end portion of the rotary shaft 51*a* of the conveyance screw 51 in the width direction W. The cams 52 rotate together with the conveyance screw 51 about the rotary shaft 51*a*. The cams 52 and the rotary shaft 51*a* may be aimed as either a single component or separate components. It is to be noted that the position of the rotary shaft 51*a* that is the center of rotation of the cams 52 is eccentric from the circular center of the cams 52 so that the cams 52 can function as "cams" as the conveyance screw 51 rotates. The cams 52 can serve as drive transmitters to drive the pushing member 41 (first conveyance member), and the arms 41*b* of the pushing member 41 are hung on the respective cams 52.

Additionally, the screw portion 51*b* winding around the rotary shaft 51*a* of the conveyance screw 51 extends only from one end (on the right in FIG. 7) to a center portion in the width direction W, except the axial end portions of the rotary shaft 51*a* where the cams 52 are positioned. More specifically, the screw portion 51*b* is positioned on the side where the waste toner inlet portion 32 projects beyond the waste toner reservoir 31 (to the right in FIG. 7) to balance the waste toner transported from the projecting portion of the waste toner inlet portion 32 to the waste toner reservoir 31 and the waste toner accumulating in the waste toner inlet portion 32 in the width direction W. In other words, the screw portion 51*b* positioned in the projecting portion of the waste toner inlet portion 32 can prevent the waste toner from being retained in that portion. Further, providing the screw portion 51*b* on only one side in the width direction W can reduce the driving torque of the conveyance screw 51.

The screw portion 51*b* is designed to transport the waste toner away from the cam 52 on the right in FIG. 7. This configuration can prevent adhesion of waste toner to the cam 52 and defective drive transmission between the cam 52 and the pushing member 41 (first conveyance member).

It is to be noted that, referring to FIG. 7, a gear 71 provided on one end portion of the rotary shaft 51*a* of the conveyance screw 51 engages a driving gear provided in the apparatus body. With a driving force transmitted from the driving gear to the gear 71, the conveyance screw 51 is rotated in a predetermined direction and transports the waste toner from the right end portion in FIG. 7 to the center portion not the left end portion in FIG. 7 as indicated by arrow W1.

By contrast, the pushing member 41 includes the planar portion 41*a* provided inside the waste toner reservoir 31 and the arms 41*b* connected to either end portion in the width direction W of the planar portion 41*a*. Further, the arms 41*b* are connected to the planar portion 41*a* in an end portion on the proximal side in the depth direction D1 (shown in FIG. 6), that is, the side close to the waste toner inlet portion 32.

Figure 8:
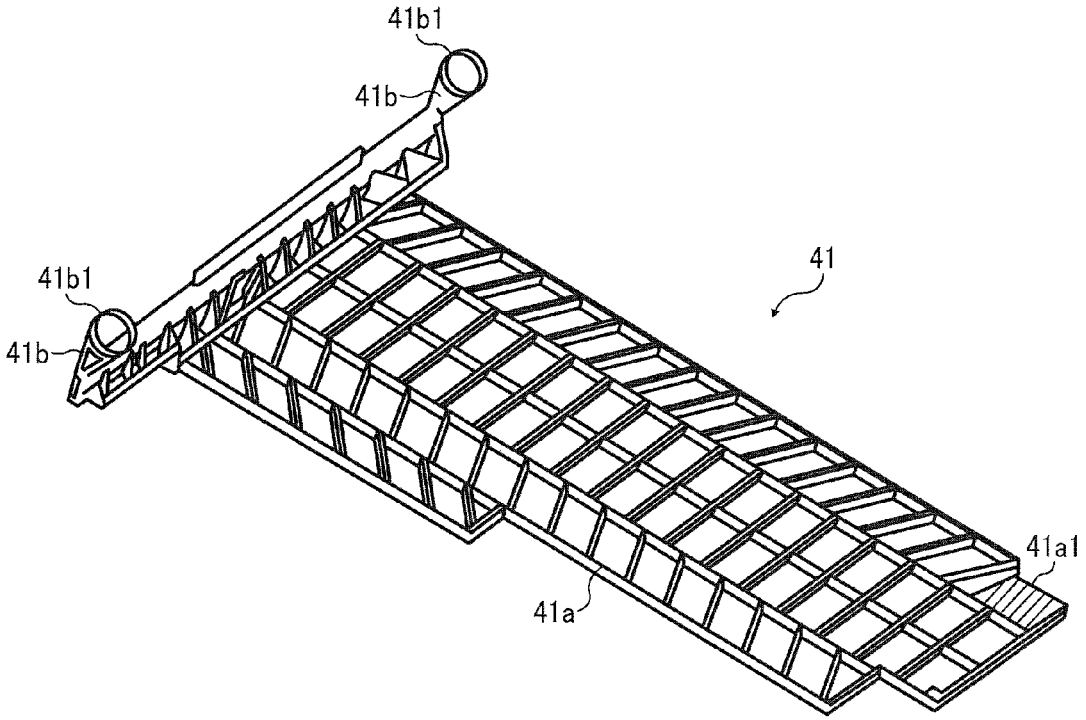
FIG. 8 is a perspective view illustrating a first conveyance member.
Figure 9:
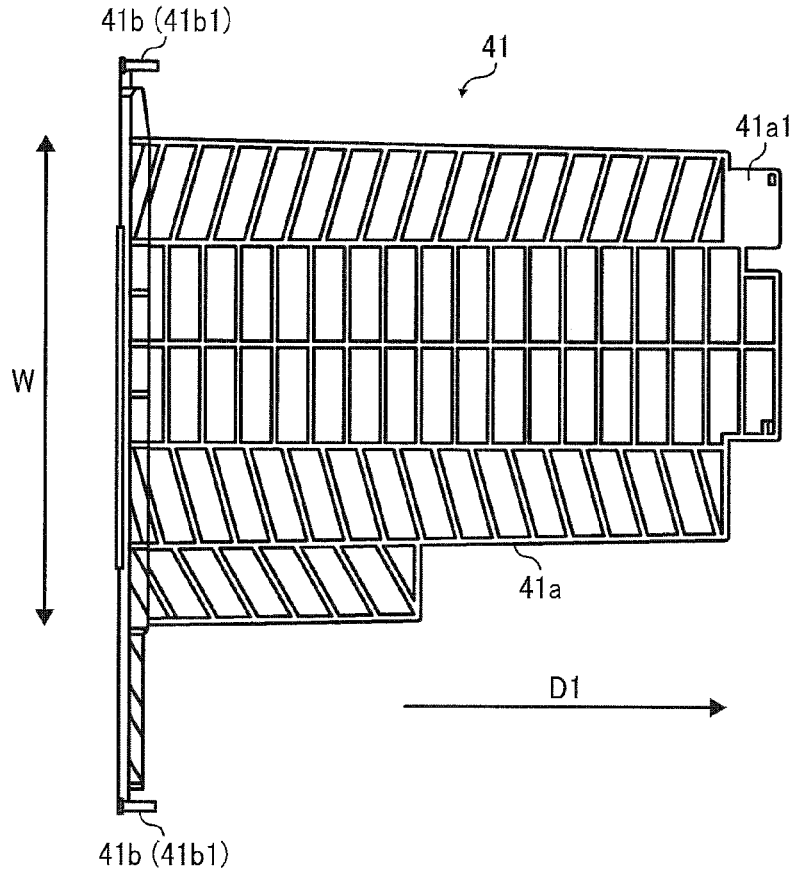
FIG. 9 is a top view of the first conveyance member.
Figure 10:
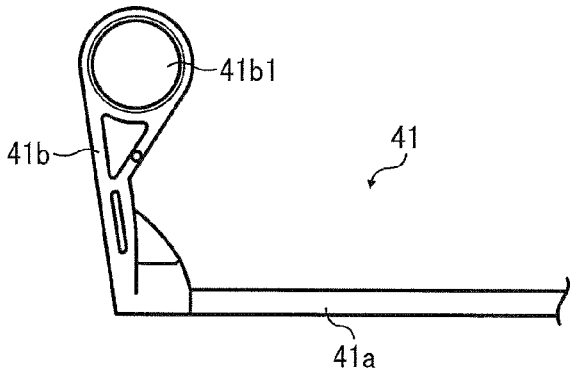
FIG. 10 is a side view of an arm of the first conveyance member.
Figure 11:
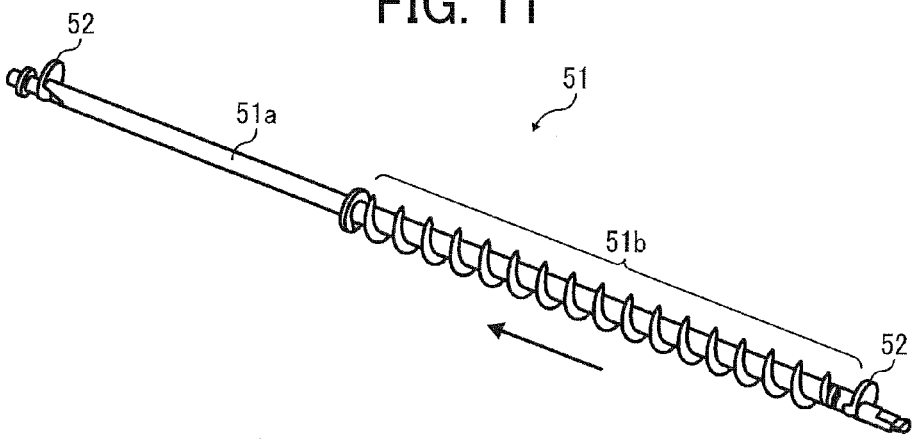
FIG. 11 is a perspective view illustrating a second conveyance member.
Figure 12:
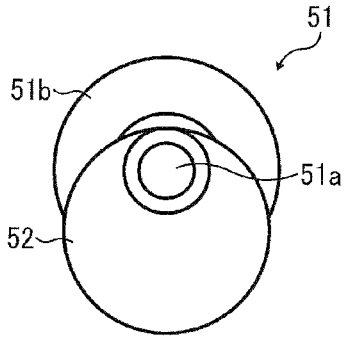
FIG. 12 is a side view of the second conveyance member.

As shown in FIGS. 8 and 9, the planar portion 41*a* of the pushing member 41 is substantially grid-shaped and serves as the planar grid portion. More specifically, when viewed from above or below, multiple rectangular penetration holes are arranged lengthwise and crosswise in the planar portion 41*a* like lacework.

In the first embodiment, in a center portion in the width direction W of the planar portion 41*a*, the grid is substantially rectangular in parallel to the direction in which waste toner is transported (indicated by arrow D1, to the right in FIG. 9) and the direction substantially perpendicular thereto. In both end portions in the width direction W, the grid is shaped like parallelograms with the two sides crossing the direction indicated by arrow D1 are inclined. More specifically, the center side in the width direction W of the two sides are upstream in the direction indicated by arrow D1 from the outer side. Additionally, the inclination of the grid in one end portion in the width direction W (on the lower side in FIG. 9) of the planar portion 41*a* is greater than the inclination of the grid in the center portion in the width direction W. With this configuration, the waste toner can be distributed entirely in the waste toner reservoir 31 as the pushing member 41 moves.

It is to be noted that the term "grid-shaped" used in this specification includes, in addition to an arrangement in which multiple rectangular penetration holes are regularly arranged in a matrix, arrangements in which multiple penetration holes (not limited to rectangular holes) are arranged at random.

Additionally, each arm 41*b* of the pushing member 41 includes a substantially O-shaped end portion 41*b*1 (shown in FIG. 8) hanging on the cam 52 of the conveyance screw 51 like a hook. With this configuration, a drive force of the conveyance screw 51 can be transmitted via the contact portions between the arms 41*b* and the cams 52 to the pushing member 41. In other words, the pushing member 41 receives the drive force via the contact portions between the end portions 41*b*1 of the arms 41*b* and the cams 52 from the conveyance screw 51 and swings in conjunction with rotation of the conveyance screw 51 with the planar portion 41*a* changing its inclination relative to the depth direction D1 shown in FIG. 3.

More specifically, referring to FIG. 3, as the cams 52 rotate eccentrically about the rotary shaft 51*a*, the planar portion 41*a* of the pushing member 41 connected to the arms 41*b* moves vertically as indicated by broken lines and slides in the depth direction D1. That is, the planar portion 41*a* swings while changing its position in the depth direction D1 as well as its inclination to the depth direction D1. While moving as described above, the grid-shaped planar portion 41*a* of the pushing member 41 gradually pushes the waste toner accumulating beneath the waste toner inlet portion 32 to the distal side in the depth direction D1 (in FIG. 3, from the left to the right). Thus, the waste toner can be contained in the entire waste toner reservoir 31 extending in the depth direction D1, filling the space therein to its capacity.

In the waste toner container 30 according to the first embodiment, the pushing member 41 is driven in conjunction with driving of the conveyance screw 51 as described above. Further, the contact portions between the end portions 41*b*1 of the arms 41*b* and the cams 52 to transmit the drive force from the conveyance screw 51 to the pushing member 41 is positioned outside the waste toner reservoir 31. That is, the drive transmission portions are positioned in both end portions of the waste toner inlet portion 32 in the width direction W.

With this arrangement, the waste toner accumulating in the waste toner reservoir 31 is less likely to adhere to the drive connection portion (contact portion) between the pushing member 41 and the conveyance screw 51. Therefore, the pushing member 41 can be driven reliably in conjunction with driving of the conveyance screw 51, preventing or reducing malfunction of the pushing member 41. As a result, the large-capacity waste toner container 30 can be filled with the waste toner entirely.

In particular, the cams 52 provided on the conveyance screw 51 are positioned in either end portion in the width direction W in the waste toner inlet portion 32, outside the five inlets 32*a*1Y, 32*a*1M, 32*a*1C, 32*a*1BK, and 32*a*1T in the width direction W. Additionally, the screw portion 51*b* of the conveyance screw 51 is designed to transport the waste toner toward the center portion in the width direction W.

With this configuration, the waste toner flowing to the waste toner inlet portion 32 is less likely to come in direct contact with the cams 52 or the drive connection portions (contact portions with the arms 41*b*) to transmit the drive force to the arms 41*b*, securing prevention of malfunction of the pushing member 41.

In the first embodiment, referring to FIG. 3, the waste toner inlet portion 32 includes the ceiling portion 32*a* facing the lower side of the conveyance tubes 16, extending along the direction in which the conveyance tubes 16 extend (lateral direction in FIG. 3). The inlets 32*a*1 that communicate with the outlets 16*a* of the respective conveyance tubes 16 are formed in the ceiling portion 32*a*.

Additionally, a tapered portion 32*a*-1 is formed on the right side in FIG. 3 of the ceiling portion 32*a* of the waste toner inlet portion 32, which is a distal side in the depth direction D1 in which the waste toner container 30 is installed in the apparatus body. The tapered portion 32*a*-1 is inclined down toward the right in FIG. 3 (to the distal side in the installation direction indicated by arrow D1). The tapered portion 32*a*-1 of the waste toner inlet portion 32 can secure smooth attachment and removal of the waste toner container 30 from the apparatus body (conveyance tubes 16).

Referring to FIG. 6, the ceiling portion 32*a* of the waste toner inlet portion 32 further includes positioning pins 32*b* on the proximal side (on the right in FIG. 6) in the installation direction indicated by arrow D1 of the waste toner container 30, and a positioning hole formed in an end of each conveyance tube 16 engages the positioning pin 32*b*.

More specifically, the ceiling portion 32*a* includes a standing portion or vertical wall 32*a*-2 projecting upward on the proximal side (upstream side) in the installation direction indicated by arrow D1. The positioning pin 32*b* projects horizontally from the vertical wall 32*a*-2. In installation of the waste toner container 30 into the apparatus body, when the positioning pins 32*b* of the waste toner container 30 engage the positioning holes of the respective conveyance tubes 16, the position of the waste toner container 30 is determined relative to the apparatus body (conveyance tubes 16). In that state, the outlets 16*a* of the conveyance tubes 16 communicate with the respective inlets 32*a*1, and the waste toner flows through the conveyance tubes 16 into the waste toner container 30.

Referring to FIG. 3, in the waste toner container 30 according to the first embodiment, the waste toner detection unit 54 is provided on the distal side of the waste toner reservoir 31 in the installation direction (indicated by arrow D1) and above a distal end portion of the planar portion 41*a* of the pushing member 41. As the amount of waste toner accumulating in the waste toner reservoir 31 increases, the distal end portion of the pushing member 41 moves up, and then the waste toner detection unit 54 can recognize that the predetermined amount of waste toner is collected in the waste toner container 30.

More specifically, as shown in FIGS. 13, and 14, as the amount of the waste toner collected in the waste toner container 30 (waste toner reservoir 31) increases, the downstream end portion of the pushing member 41 in the direction indicated by arrow D1 (on the left in FIG. 13) is gradually pushed up by the waste toner accumulating in the waste toner reservoir 31. The pushing member 41 can thus move because the downstream end portion is free with the other end portion (arms 41*b* shown in FIG. 3) hanging on the conveyance screw 51. When the waste toner is fully contained on the downstream side of the waste toner reservoir 31 in the direction indicated by arrow D1 (on the left in FIG. 13), the free end portion of the pushing member 41 is pushed up by the waste toner. While the waste toner reservoir 31 is not yet filled with waste toner, the pushing member 41 is at the position shown in FIG. 6 and swings. The pushing member 41 moves and reaches to the position shown in FIG. 14 when the waste toner reservoir 31 is filled to capacity.

It is to be noted that, in FIG. 14, reference numeral 200 indicated by dashed lines represents a container mount in which the waste toner container 30 is installed, formed in the apparatus body of the image forming apparatus 1.

When the downstream end portion of the pushing member 41 is lifted adjacent to the top end of the waste toner reservoir 31 as shown in FIG. 14, the waste toner reservoir 31 is entirely filled to capacity with the waste toner, and additionally the waste toner is contained in the waste toner inlet portion 32. Then, the waste toner detection unit 54 detects the end portion of the pushing member 41 thus lifted.

Figure 15A:
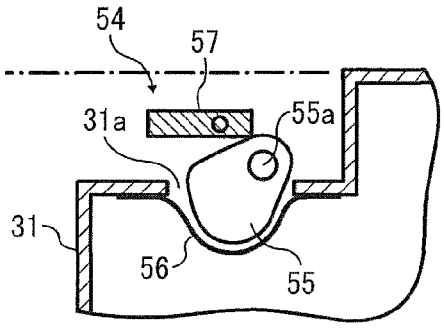
FIGS. 15A and 15B are enlarged cross-sectional views illustrating movement of a movable member in a waste toner detection unit.

As shown in FIG. 15A, an opening 31*a* is formed in an upper portion of the waste toner reservoir 31 on the downstream side in the direction indicated by arrow D1, and the flexible sheet 56 serving as a flexible sheet member is provided to cover the opening 31*a* with slackage. The flexible sheet 56 may be bonded to the inner wall of the waste toner reservoir 31 surrounding the opening 31*a*. The flexible sheet 56 is designed to deform upward, pushed directly or via the waste toner by the end portion of the pushing member 41 lifted to that position. For example, the flexible sheet 56 can be a rubber member of 1 mm or thinner.

The filler 55 serving as a movable member is disposed to contact the flexible sheet 56 from outside the waste toner container 30 and supported by the waste toner container 30 rotatably around a support axis 55*a*. The filler 55 moves, pushed via the flexible sheet 56 by the pushing member 41 that moves as the amount of the waste toner increases. Then, the photosensor 57 detects the positional change of the filler 55.

Figure 15B:
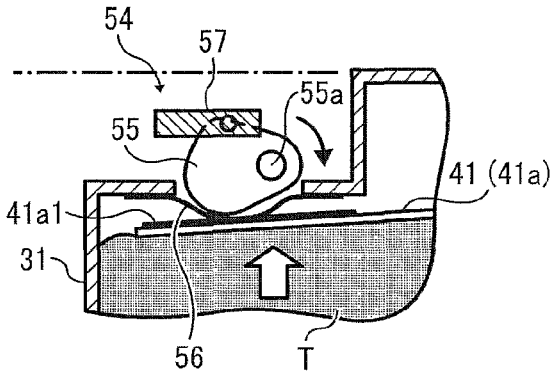

While the waste toner container 30 is not yet filled to capacity with the waste toner, as shown in FIGS. 6, 13, and 15A, the filler 55 is kept at a position not to be detected by the photosensor 57. By contrast, when the waste toner container 30 is filled to capacity or close to capacity with the waste toner, as shown in FIGS. 14 and 15B, the filler 55 rotates, together with the flexible sheet 56, to a position detected by the photosensor 57.

The photosensor 57 consists essentially of a light-emitting element and a light-receiving element and recognizes the position of the filler 55, determining whether the light emitted from the light-emitting element toward the light-receiving element is blocked by the filler 55 positioned therebetween.

It is to be noted that, although the photosensor 57 is provided to the apparatus body in the first embodiment, alternatively, the photosensor 57 may be provided to the waste toner container 30.

In the first embodiment, the waste toner detection unit 54 thus configured is disposed facing the distal end portion (downstream side in the depth direction D1) of the planar portion 41*a* of the pushing member 41 and positioned above the planar portion 41*a*. Compared with a configuration in which the waste toner detection unit 54 is disposed on the proximal side (upstream side in the depth direction D1), the amount by which the pushing member 41 moves is greater. Accordingly, the waste toner detection unit 54 can detect the pushing member 41, which moves as the amount of the waste toner increases, with a higher degree of accuracy. Additionally, the photosensor 57 detects the flexible sheet 56 and the filler 55, (detected members), that are moved directly by the pushing member 41. Therefore, compared with a detection method in which the detector detects a member moved by waste toner, whether the waste toner container 30 is full can be detected more accurately.

As a footnote, in the L-shaped and large-capacity waste toner container 30, it is difficult to accurately determine whether the waste toner reservoir 31 is substantially filled with waste toner and additional amount of waste toner is contained in the waste toner inlet portion 32. The position of the waste toner detection unit 54 in the present embodiment is to enhance the detection accuracy of the state described above.

In the first embodiment, referring to FIGS. 8 and 9, the planar portion 41*a* of the pushing member 41 includes a non-grid portion 41*a*1 disposed facing the flexible sheet 56 and the filler 55 of the waste toner detection unit 54. It is to be noted that, although the non-grid portion 41*a*1 in the present embodiment is a separate planar plastic sheet such as Mylar (registered trademark of DuPont) bonded to the planar portion 41*a*, alternatively, the non-grid portion 41*a*1 and the planar portion 41*a* may be formed as a single united component.

With this configuration, the waste toner detection unit 54 can reliably recognize the positional change (upward movement) of the pushing member 41 because a relatively large face of the non-grid portion 41*a*1 pushes the waste toner detection unit 54.

It is to be noted that, when the waste toner detection unit 54 detects the upward movement of the pushing member 41 intermittently, it is assumed that the waste toner container 30 is nearly full with waste toner. By contrast, when the waste toner detection unit 54 detects the upward movement of the pushing member 41*a* predetermine number of times (five times, for example) consecutively, it is assumed that the waste toner container 30 is filled to capacity with waste toner.

Specifically, when the waste toner detection unit 54 detects that the waste toner container 30 is nearly full, the display provided to the apparatus body reports it to users. Thus, the user (or service person) can assume that the waste toner container 30 will become full shortly and prepare for it although the apparatus becomes unusable when the waste toner container 30 is full. Accordingly, downtime of the apparatus can be reduced. When the waste toner detection unit 54 determines that the waste toner container 30 is full, the controller 101 stops operation of the apparatus as well as conveyance of the waste toner to the waste toner container 30 and causes the display provided in the apparatus body to report that state. Then, recognizing that the waste toner container 30 is filled to capacity with the waste toner, users or service persons can replace the waste toner container 30.

Additionally, in the first embodiment, referring to FIGS. 15A and 15B, the filler 55 is designed to move within a predetermined movable range not to exceed the upper end of the waste toner reservoir 31 (indicated by alternate long and short dashed lines). In other words, the filler 55 is designed to be beneath the upper end of the waste toner reservoir 31 both when the waste toner container is full and not full. Specifically, the upper portion of the waste toner reservoir 31 includes a portion recessed from the upper end (indicated by the short dashed lines in FIGS. 15A and 15B) on the distal side in the depth direction D1, shown in FIG. 14, and the waste toner detection unit 54 is disposed in the recessed portion.

With this configuration, when the waste toner container 30 is installed and removed from the box-shaped container mount 200 shown in FIG. 14 of the apparatus body, interference of the filler 55 can be prevented.

It is to be noted that, in FIG. 15B, reference character T represents waste toner contained in the waste toner container 30.

Additionally, referring to FIG. 4, the waste toner reservoir 31 further includes an engagement portion 31*c* with which the position of the waste toner reservoir 31 relative to the apparatus body is determined in the first embodiment, and the waste toner detection unit 54 is disposed in an end portion in the width direction W and adjacent to the engagement portion 31*c*.

Specifically, the waste toner reservoir 31 further includes a pair of guided portions 31*b* that engages a pair of guide rails formed in the container mount 200 of the apparatus body. The guided portions 31*b* are formed on either end portion in the width direction W. In installation and removal of the waste toner container 30 from the apparatus body, the waste toner container 30 is moved in the depth direction D1 (shown in FIG. 3) with the guided portions 31*b* engaging the respective guide rails formed in the apparatus body.

The engagement portion 31*c* is a recess formed on the distal side or downstream side of the waste toner container 30 in the depth direction D1 (shown in FIG. 3) and engages a positioning projection formed in the container mount 200 of the apparatus body. When the waste toner container 30 guided by the guide rails formed in the apparatus body reaches a position where the engagement portion 31*c* engages the positioning projection formed on the distal side of the apparatus body, the position of the waste toner container 30 relative to the apparatus body is determined.

In the present embodiment, disposing the waste toner detection unit 54 adjacent to the engagement portion 31*c* can facilitate positioning of the filler 55 relative to the photosensor 57 formed in the apparatus body 1 in installation of the waste toner container 30. Accordingly, defective detection of the waste toner detection unit 54 can be reduced.

It is to be noted that, in the present embodiment, referring to FIG. 7, the number of inlets 32*a*1 formed in an area in the width direction W where the screw portion 51*b* of the conveyance screw 51 extends is greater than the number of inlets 32*a*1 formed in the other area in the width direction W where the screw portion 51*b* is not present. Specifically, three inlets 32*a*1Y, 32*a*1M, and 32*a*1T are formed in the area where the screw portion 51*b* extends (on the right in FIG. 7), and two inlets 32*a*1C and 32*a*1BK are formed in the other area (on the left in FIG. 7).

This configuration can facilitate adjustment of the balance or level of the waste toner transported to the waste toner reservoir 31 as well as the balance or level of the waste toner accumulating in the waste toner inlet portion 32. Specifically, the amount of waste toner conveyed in the width direction is greater in the area where the screw portion 51*b* is present. Accordingly, the waste toner can be leveled better when the screw portion 51*b* is provided in the area where the number of inlets is greater.

Additionally, in the present embodiment, as shown in FIG. 7, the inlet 32*a*1T for the waste toner removed from the intermediate transfer member is formed in an end in the width direction W (on the right in FIG. 7), whereas the inlet 32*a*1BK for black is formed the other end portion (on the left in FIG. 7). This configuration can facilitate adjustment of the balance or level of the waste toner transported to the waste toner reservoir 31 as well as the balance or level of the waste toner accumulating in the waste toner inlet portion 32.

Black and white images are generally printed more frequently than multicolor images or other single color images, and four single-color images are superimposed on the intermediate transfer belt 17. Therefore, the amount of waste toner flowing from the inlet 32*a*1BK and that from the inlet 32*a*1T are greater than the amount of waste toner flowing from the inlet 32*a*1Y, 32*a*1M, or 32*a*1C. If the inlets 32*a*1BK and 32*a*1T are positioned close to each other or close to the center in the width direction, the level of the waste toner in the end portions might be lower. Such an inconvenience, however, can be restricted when the inlets 32*a*1BK and 32*a*1T at which the amount of waste toner is greater are positioned in either end portion in the width direction. In such a configuration, the waste toner accumulating in the waste toner inlet portion 32 can be leveled uniformly in the width direction.

Moreover, generally the amount of waste toner flowing from the inlet 32*a*1T for intermediate transfer belt 17 is greater than the amount of black waste toner flowing from the inlet 32*a*1BK. Therefore, the inlet 32*a*1T is on the side where the screw portion 51*b* is provided to actively transport the waste toner in the width direction, thereby leveling the waste toner in the width direction.

In the present embodiment, the non-grid portion 41*a*1 provided to the planar portion 41*a* of the pushing member 41 can enhance the detection accuracy of the waste toner detection unit 54.

Figure 16:
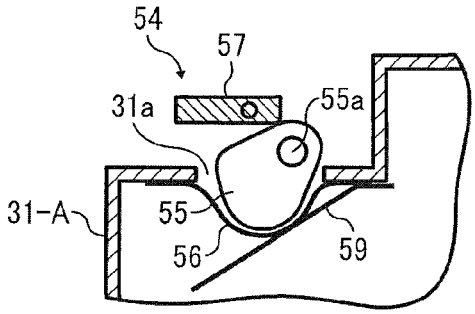
FIG. 16 illustrates a waste toner detection unit and adjacent portion according to a variation.

By contrast, FIG. 16 illustrates a waste toner reservoir 31-A as a variation that includes a plastic sheet 59, such as Mylar (registered trademark of DuPont), serving as a planar member disposed between the planar portion 41*a* of the pushing member 41 and the waste toner detection unit 54 instead of the non-grid portion 41*a*1. An end (fixed end) of the plastic sheet 59 is bonded to a ceiling of the waste toner reservoir 31-A, and the other end (free end) thereof is disposed facing the flexible sheet 56 and between the flexible sheet 56 and the distal end portion of the pushing member 41. With this configuration, when the planar portion 41*a* moves upward as the amount of waste toner increases, the plastic sheet 59 also moves upward, pushed by the planar portion 41*a*. Therefore, it can be recognized that the waste toner container 30 is full similarly to the above-described embodiment.

With the plastic sheet 59 provided to the ceiling of the waste toner reservoir 31-A, the waste toner detection unit 54 can reliably recognize the positional change (upward movement) of the pushing member 41 because a relatively large face of the plastic sheet 59 pushes the waste toner detection unit 54 similarly to the non-grid portion 41*a*1.

As described above, in the above-described embodiment, the waste toner container 30 includes the waste toner reservoir 31 extending in the depth direction, the waste toner inlet portion 32 positioned above the waste toner reservoir 31 and projecting upward, the first and second conveyance members 41 and 51 respectively provided in the waste toner reservoir 31 and the waste toner inlet portion 32, and the waste toner detection unit 54 to detect the positional change of the pushing member 41 that moves as the amount of waste toner increases. With this configuration, the waste toner can be contained in the entire large-capacity waste toner container 30, and it can be reliably recognized whether or not the waste toner container 30 is full.

Second Embodiment

Figure 17:
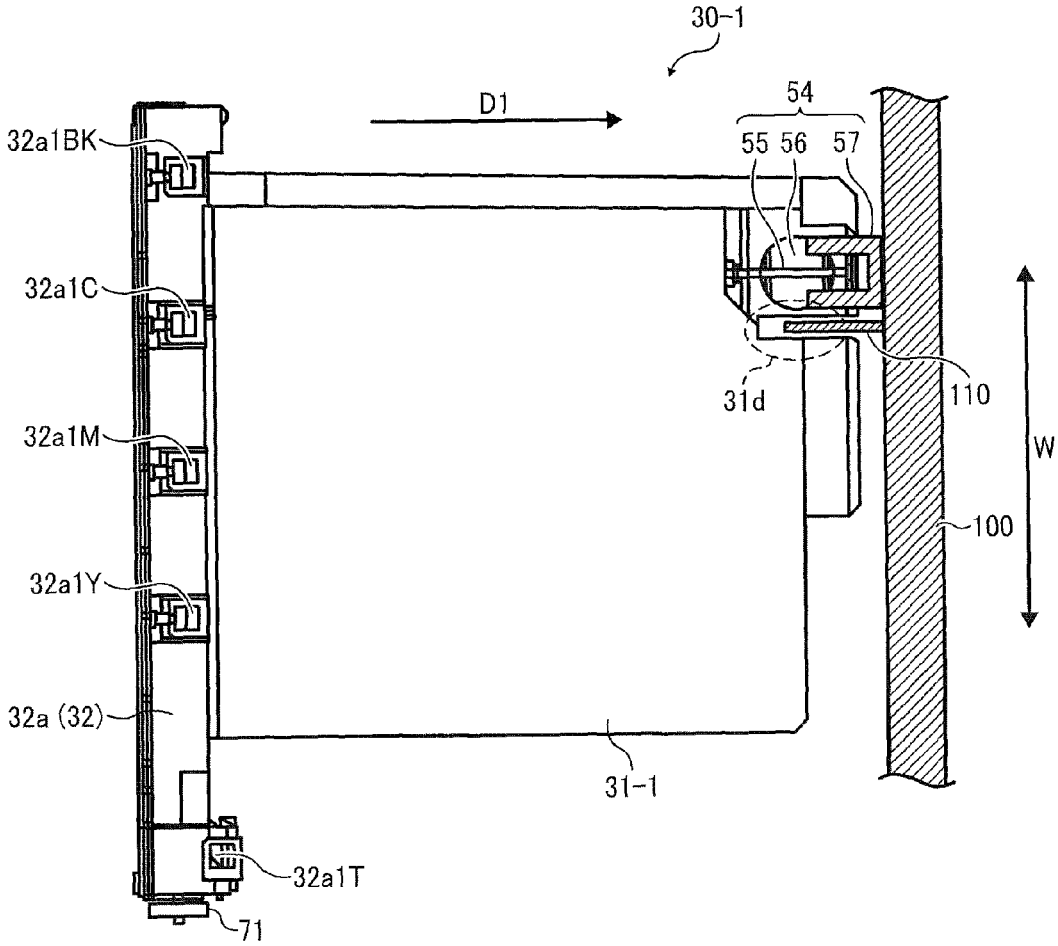
FIG. 17 illustrates a waste toner container according to another embodiment.
Figure 18A:
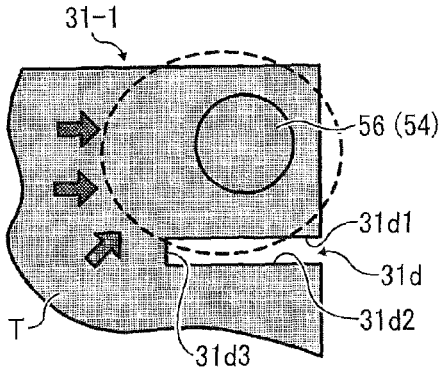
FIG. 18A is a schematic view illustrating flow of waste toner adjacent to the waste toner detection unit in the waste toner container in FIG. 17.
Figure 18B:
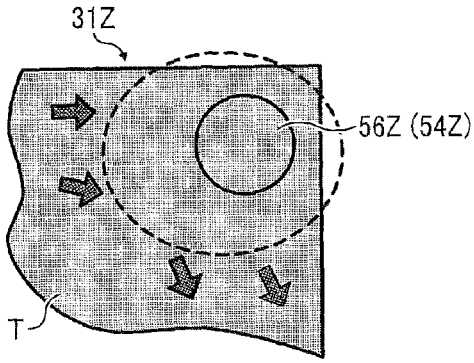
FIG. 18B is a schematic view illustrating flow of waste toner adjacent to the waste toner detection unit in a comparative waste toner container.

Referring to FIGS. 17, 18A, and 18B, a second embodiment is described below.

FIG. 17 is a top view of a waste toner container 30-1 according to the second embodiment and corresponds to FIG. 5 in the above-described first embodiment. FIG. 18A is a schematic view illustrating flow of waste toner adjacent to a waste toner detection unit 54 in the waste toner container 30-1 as viewed from above. FIG. 18B is a schematic view illustrating flow of waste toner adjacent to a waste toner detection unit 54Z in a comparative waste toner container in which a partition is not provided as viewed from above.

The waste toner container 30-1 is different from that in the first embodiment in that a partition (formed by inner walls defining a recess 31*d*) is provided adjacent to the waste toner detection unit 54.

Referring to FIG. 17, similarly to the first embodiment, the waste toner container 30-1 includes a waste toner reservoir 31-1 and a waste toner inlet portion 32, and substantially L-shaped when viewed from a side. Additionally, the conveyance screw 51 (second conveyance member) is provided in the waste toner inlet portion 32, and the pushing member 41 (first conveyance member) and the waste toner detection unit 54 are provided in the waste toner reservoir 31-1.

The waste toner detection unit 54 in the second embodiment includes a flexible sheet 56 as a flexible member, a filler 55 as a movable member, and a photosensor (optical director) 57 as a detector similarly to the first embodiment. Additionally, the waste toner detection unit 54 is disposed on the distal side (downstream side) in the depth direction D1 and in an end portion in the width direction W. The waste toner detection unit 54 detects changes in position of the pushing member 41 in accordance with increases in the amount of the waste toner.

In the second embodiment, referring to FIGS. 17 and 18A, the waste toner reservoir 31-1 further includes the recess 31*d* defined by inner walls 31*d*1, 31*d*2, and 31*d*3 disposed adjacent to the waste toner detection unit 54. The recess 31*d* extends in the depth direction D1 as well as a vertical direction (perpendicular to the surface of the paper on which FIG. 17 is drawn). That is, the interior of the waste toner reservoir 31-1 adjacent to the waste toner detection unit 54 is partly divided by the partition formed by the inner walls 31*d*1, 31*d*2, and 31*d*3 defining the recess 31*d*.

With this configuration, as shown in FIG. 18A, among the waste toner T pushed to the distal side in the depth direction D1 by the pushing member 41, the waste toner T flowing adjacent to the waste toner detection unit 54 is regulated by the partition. The waste toner T is then compressed in an area enclosed by broken lines shown in FIG. 18A because the partition restricts the direction in which the waste toner T flows. Accordingly, in the area adjacent to the waste toner detection unit 54, the waste toner T thus compressed can exert a sufficient force to push the flexible sheet 56 of the waste toner detection unit 54 together with the pushing member 41. Thus, the detection accuracy of the waste toner detection unit 54 can increase.

More specifically, referring to FIG. 18B, which illustrates a comparative waste toner reservoir 31Z, if the partition is not provided adjacent to the waste toner detection unit 54Z, the waste toner T transported to the adjacent area by the pushing member 41 does not remain but diffuses as indicated by bold arrows shown in FIG. 18B. In such a case, the force exerted by the waste toner T to push the flexible sheet 56Z of the waste toner detection unit 54Z together with the pushing member 41 might be insufficient.

Further, referring to FIG. 17, the recess 31*d* of the waste toner reservoir 31-1 according to the second embodiment serves as engagement recess that engages an apparatus frame 100 of the image forming apparatus 1 and determines the position of the waste toner reservoir relative to the apparatus body.

More specifically, the apparatus frame 100 of the image forming apparatus 1 includes a positioning projection 110 (positioning member), in addition to the photosensor 57, disposed facing an edge face of the distal side in the depth direction D1 of the waste toner reservoir 31-1. In conjunction with installation of the waste toner container 30-1 into the apparatus body, the positioning projection 110 of the apparatus body engages the recess 31*d* formed in the waste toner container 30-1. Thus, the position of the waste toner reservoir 31-1 relative to the apparatus body is determined. Then, the inner walls 31*d*1, 31*d*2, and 31*d*3 defining the recess 31*d*, which is recessed from the outer wall of the waste toner reservoir 31-1, serves as the partition.

When the partition (recess 31*d*) serves as the engagement portion as well, the limited space inside the waste toner reservoir 31-1 can be used effectively. Alternatively, the partition and the engagement portion may be separate members. In such a configuration, the detection accuracy of the waste toner detection unit 54 can be high similarly.

As described above, the second embodiment has a similar configuration and can attain effects similar to those in the above-described first embodiment. With this configuration, the waste toner can be contained in the entire large-capacity waste toner container 30, and it can be reliably recognized whether or not the waste toner container 30 is full.

In the above-described embodiments, the respective components (i.e., the photoreceptor drum 11, the charging roller 12, the development device 13, and the cleaning unit 15) of the image forming unit are housed in a common unit casing as the process cartridge 10 to make the image forming unit compact and to facilitate maintenance work. By contrast, the waste toner container 30 may be incorporated in the process cartridge 10. Yet alternatively, not all but two or more of these components may be housed in a common unit casing as the process cartridge 10. It is to be noted that it is not necessary to unit the photoreceptor drum 11, the charging roller 12, the development device 13, and the cleaning unit 15 as a single unit and may be installed in the apparatus body so as to be replaced separately. In such a configuration, similar effects can be attained as well.

Additionally, although the description above concerns the image forming apparatus including the two-component development device 13 using two-component developer, the features of the above-described embodiments can adapt to image forming apparatuses including one-component development devices using one-component developer.

It is to be noted that the term "process cartridge" used in this specification means an integrated unit including an image bearer and at least one of a charging unit, a development device, and a cleaning unit housed in a common unit casing and is designed to be removably installed in an apparatus body of the image forming apparatus.

Further, although the description above concerns the configuration in which the five inlets 32*a*1Y, 32*a*1M, 32*a*1C, 32*a*1BK, and 32*a*1T are formed in the waste toner inlet portion 32, the number of the waste toner inlets is not limited to five. In such a configuration, similar effects can be attained as well.

The number, position, shape of the components of the image forming apparatus described above are not limited to those described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A waste toner container used in an image forming apparatus, comprising:

a waste toner reservoir extending in a depth direction of the image forming apparatus for containing waste toner removed from an image bearer;

an inlet portion provided above the waste toner reservoir, in which at least one waste toner inlet is formed to receive the waste toner flowing to the waste toner reservoir;

a first conveyance member provided in the waste toner reservoir, to transport the waste toner accumulating in the waste toner reservoir in the depth direction, the first conveyance member movable upward as the amount of the waste toner in the waste toner reservoir increases;

a second conveyance member provided in the inlet portion to transport the waste toner in a width direction perpendicular to the depth direction, the second conveyance member including a drive transmitter to transmit a driving force from the second conveyance member to the first conveyance member; and a waste toner detection unit to detect whether an amount of the waste toner in the waste toner container reaches a predetermined amount by detecting upward movement of the first conveyance member.

2. The waste toner container according to claim 1, wherein the inlet portion is disposed above a proximal portion of the waste toner reservoir in the depth direction.

3. The waste toner container according to claim 2, wherein the second conveyance member includes a rotary shaft extending in the width direction and a screw blade formed around the rotary shaft, the drive transmitter includes a cam provided to an end portion of the rotary shaft of the second conveyance member in the width direction, the first conveyance member includes a planar grid portion positioned inside the waste toner reservoir and an arm connected to a proximal end portion of the planar grid portion and hung on the first cam provided to the rotary shaft of the second conveyance member, the planar grid portion of the first conveyance member changes a position and an inclination to the depth direction as the second conveyance member rotates, receiving the driving force from the cam of the second conveyance member via and the arm of the first conveyance member, and the waste toner detection unit is positioned above an distal end portion of the planar grid portion of the first conveyance member in the depth direction.

4. The waste toner container according to claim 3, wherein the planar grid portion of the first conveyance member comprises a non-grid portion positioned in the distal end portion in the depth direction and facing the waste toner detection unit.

5. The waste toner container according to claim 3, wherein the waste toner reservoir further comprises a planer member disposed between the planar grid portion of the first conveyance member and the waste toner detection unit, and the planar member moves upward as the first conveyance member moves upward.

6. The waste toner container according to claim 1, wherein an opening is formed in an upper portion of the waste toner reservoir, and the waste toner detection unit includes:

a flexible sheet member to cover the opening formed in the upper portion of the waste toner reservoir and deform when pushed either directly or indirectly by the first conveyance member;

a movable member disposed outside the waste toner reservoir to contact the flexible sheet member externally, the movable member movable when pushed by the first conveyance member via the flexible member; and a detector to detect the movement of the movable member.

7. The waste toner container according to claim 6, wherein the movable member of the waste toner detection unit is movable within a predetermined range lower than an upper end of the waste toner reservoir.

8. The waste toner container according to claim 1, wherein the waste toner reservoir further comprises an engagement portion to determine a position of the waste toner reservoir relative to an apparatus body of the image forming apparatus, the engagement portion disposed in a distal end portion in the depth direction and an end portion in the width direction, and the waste toner detection unit is disposed adjacent to the engagement portion.

9. The waste toner container according to claim 1, wherein the waste toner reservoir further comprises a partition to partly divide an interior of the waste toner reservoir, and the partition is adjacent to the waste toner detection unit and extends in a vertical direction as well as the depth direction.

10. The waste toner container according to claim 9, wherein an engagement recess to engage an apparatus body of the image forming apparatus is formed in the waste toner reservoir to determine a position of the waste toner container relative to the image forming apparatus, the partition formed inside the waste toner reservoir is constructed of inner walls defining the engagement recess.

11. An image forming apparatus comprising:

an image forming unit to form a toner image on an image bearer;

a cleaning unit to remove untransferred toner as waste toner form the image bearer after the toner image is transferred therefrom; and a waste toner container for containing the waste toner discharged from the cleaning unit, removably installable in an apparatus body of the image forming apparatus, the waste toner container including:

a waste toner reservoir extending in a depth direction of the image forming apparatus;

an inlet portion provided above the waste toner reservoir, in which at least one waste toner inlet is formed to receive the waste toner flowing to the waste toner reservoir;

a first conveyance member provided in the waste toner reservoir, to transport the waste toner accumulating in the waste toner reservoir in the depth direction, the first conveyance member movable upward as the amount of the waste toner in the waste toner reservoir increases;

a second conveyance member provided in the inlet portion to transport the waste toner in a width direction perpendicular to the depth direction, the second conveyance member including a drive transmitter to transmit a driving force from the second conveyance member to the first conveyance member; and a waste toner detection unit to detect whether an amount of the waste toner in the waste toner container reaches a predetermined amount by detecting upward movement of the first conveyance member.

* * * * *